United States Patent [19]

Hommes et al.

[11] Patent Number: 5,022,297

[45] Date of Patent: Jun. 11, 1991

[54] METHOD AND APPARATUS FOR PREPARING SHEET STACKS

[75] Inventors: William J. Hommes, Hockessin, Del.; Alfred J. Schmidt, Augsburg, Fed. Rep. of Germany

[73] Assignee: E. I. Du Pont de Nemours and Company, Wilmington, Del.

[21] Appl. No.: 528,360

[22] Filed: May 25, 1990

[51] Int. Cl.[5] ..... B26D 7/02

[52] U.S. Cl. ..... 83/35; 83/39; 83/255; 83/404; 83/406; 83/917

[58] Field of Search ..... 83/29, 35, 39, 404, 83/404.1, 404.2, 404.4, 405, 406, 422, 439, 704, 917, 934, 255, 256, 272, 425.2

[56] References Cited

U.S. PATENT DOCUMENTS

| | | | |
|---|---|---|---|
| 968,014 | 8/1910 | White . | |
| 3,125,920 | 3/1964 | Smith | 83/454 |
| 3,516,317 | 6/1970 | Sundquist et al. | 83/467 |
| 3,739,672 | 6/1973 | Pfaffle | 83/560 X |
| 3,877,333 | 4/1975 | Illingworth et al. | 83/39 X |
| 4,407,177 | 10/1983 | Schmidt et al. | 83/374 X |
| 4,539,880 | 9/1985 | Barber et al. | 83/917 X |
| 4,789,148 | 12/1988 | Noguchi et al. | 271/94 |

OTHER PUBLICATIONS

Drawing #AVCN-PD prepared as a proposal by the W. O. Hickok Manufacturing Co. and provided to the assignee of the present invention on Feb. 12, 1988.

Drawing "Eckenstanze" prepared as a proposal by H. J. Durselen KG and provided to the assignee of the present invention on Oct. 3, 1988.

*Primary Examiner*—Mark Rosenbaum
*Assistant Examiner*—Kenneth E. Peterson
*Attorney, Agent, or Firm*—John E. Griffiths

[57] ABSTRACT

The present invention relates to a method and apparatus for automatically preparing one or more stacks of sheets, each stack having at least two substantially straight edges that meet to define a corner and, specifically, where preparing constitutes corner rounding, notching, hole punching or edge marking the stack.

28 Claims, 9 Drawing Sheets

2
4
6
8
10
12
14
16
18
20
22
24
26
28
30
32
34
36
38
40
42
44
A
B
C
D
AB
BC
CD
DA

METHOD AND APPARATUS FOR PREPARING SHEET STACKS

BACKGROUND OF THE INVENTION

1. Field of the Invention

This invention relates to a method and apparatus for automatically preparing one or more stacks of sheets, each stack having at least two substantially straight edges that meet to define a corner and, specifically, where preparing constitutes corner rounding, notching, hole punching or edge marking the stack.

2. Description of Related Art

When making sheets, such as of X-ray film, it is necessary to cut the corners round which is referred to as corner rounding. This is necessary so that the film can be readily handled in commercially available X-ray exposure equipment.

Manually aligning the corners of a film stack and die cutting the stack corners is known. See U.S. Pat. Nos. 3,125,920 and 3,516,317. However, this process is slow and alignment is unreliable.

Automated edge trimming is taught in U.S. Pat. No. 968,014 where a stack of sheets is vertically oriented in a "V" trough for aligning and cutting two edges, but not the corners. Automated on-line corner rounding by notching a running web and cutting at the notch, or by slitting and chopping the web into sheets and corner rounding individual sheets, is disclosed in U.S. Pat. No. 4,407,177. However, these automated methods of on-line corner rounding present problems with reliable alignment and rapid changeover to different sheet sizes.

It is an object of this invention to provide a method and apparatus for on-line or off-line preparation (such as corner rounding, notching, hole punching or edge marking) of sheets which is simple, accurate, operates at high speeds and requires no time for changeover to different sheet sizes.

SUMMARY OF THE INVENTION

The present invention is directed to an apparatus for preparing one or more stacks of sheets, each of the stacks having at least a first and a second substantially straight edge that meet to define a first corner comprising:

a first rotatable assembly including:

a first device rotatable about an axis, the first device having a first surface for contacting the first edge of a first one of the stacks;

first means for holding the first edge of the first stack in contact with the first surface;

first means for moving the first device from a stack loading position to a first preparing position;

a second surface for contacting the second edge of the first stack; and means for preparing the first stack at or a predetermined distance from the first corner of the first stack when the first edge is on the first surface and the second edge is on the second surface and the first corner is directed substantially downward.

The present invention is further directed to an apparatus for rounding corners of one or more stacks of sheets, each of the stacks having at least a first and a second substantially straight edge that meet to define a first corner comprising:

a first rotatable assembly including:

a first device rotatable about an axis, the first device having a first surface for contacting the first edge of a first one of the stacks;

first means for holding the first edge of the first stack in contact with the first surface;

first means for moving the first device from a stack loading position to a first cutting position;

a second rotatable assembly including:

a second device rotatable about an axis, the second device having a second surface for contacting the second edge of the first stack;

second means for holding the second edge of the first stack in contact with the second surface;

second means for rotating the second device from the first cutting position to a second position; and a first cutter positioned to cut off the first corner of the first stack in a rounded fashion when the first edge is on the first surface and the second edge is on the second surface and the first corner is directed substantially downward.

The present invention is further directed to a method for preparing one or more stacks of sheets, each of the stacks having at least a first and a second substantially straight edge that meet to define a first corner comprising:

locating the first edge of a first one of the stacks in contact with a first surface;

holding the first stack in position with respect to the first surface;

moving the first stack and the first surface to a first preparing position where the second edge of the first stack is in contact with a second surface and the first corner of the first stack is directed substantially downward; and preparing the first stack at or a predetermined distance from the first corner.

BRIEF DESCRIPTION OF THE DRAWINGS

The invention can be more fully understood from the following detailed description thereof in connection with accompanying drawings which form a part of this application and in which.

DESCRIPTION OF THE PREFERRED EMBODIMENT(S)

Figures 1A, 1B, 1C:
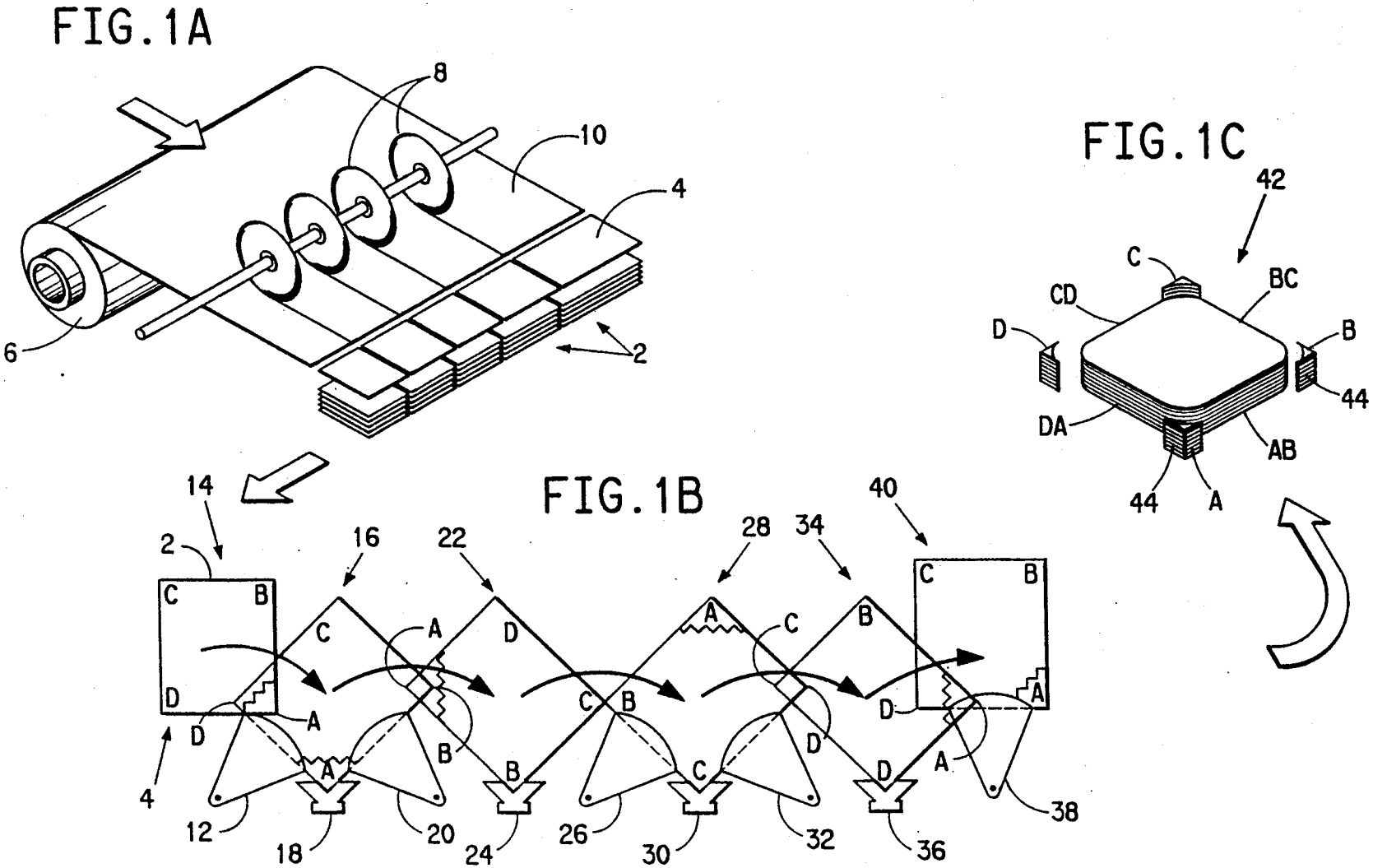
FIG. 1 is a schematic representation illustrating a process of slitting, chopping and corner rounding using the method and apparatus for preparing a stack of sheets in accordance with the present invention.

Throughout the following detailed description, similar reference characters refer to similar elements in all figures of the drawings.

FIG. 1 illustrates a process of slitting, chopping and preparing one or more stacks 2 of sheets 4. Each of the stacks 2 has at least a first substantially straight edge DA and a second substantially straight edge AB that meet to define a first corner A. The stacks 2 can comprise one or more substantially square or substantially rectangular sheets 4. The present invention is directed to a method and apparatus for performing the preparing step. Illustrative operations that may be performed in the preparing or preparation step include corner rounding, notching, hole punching or edge marking the stack 2 at or a predetermined distance from a corner of the stack 2. Throughout this specification, the preparing step or station may be referred to as a cutting step, station or cutter for ease of description, but any of the aforementioned operations can be performed.

Referring to FIG. 1, a roll 6 of material is unwound and transported to a plurality of cutters 8 that slit the material into strips 10. The strips 10 are transported to a chopper (not depicted) which chops the strips 10 into the sheets 4. The first stack 2 of the sheets 4 is rotated by a first rotatable assembly 12 from the stack loading position 14 and moved into a first preparing position 16. Then a first preparing station 18 operates on the first stack 2 at (or a predetermined distance from) the first corner A of the first stack 2 with the first corner A directed substantially downward. Then a second rotatable assembly 20 rotates the stack 2 and moves the stack 2 into a second preparing position 22. Then a second preparing station 24 operates on the stack 2 at (or a predetermined distance from) a second corner B of the stack 2 with the second corner B directed substantially downward. A third rotatable assembly 26 rotates the stack 2 and moves the stack 2 into a third preparing position 28. Then a third preparing station 30 operates on the stack 2 at (or a predetermined distance from) a third corner C of the stack 2 with the third corner C directed substantially downward. A fourth rotatable assembly 32 rotates the stack 2 and moves the stack 2 into a fourth preparing position 34. Then a fourth preparing station 36 operates on the stack 2 at (or a predetermined distance from) a fourth corner D of the stack 2 with the fourth corner D directed substantially downward. A fifth rotatable assembly 38 rotates the stack 2 and moves the stack 2 to an unloading position 40.

Assuming that the operation performed on the stack 2 at the first through fourth preparing stations 18, 24, 30, and 36 was corner rounding, then the resulting stack 2 at the unloading position 40 would be the original stack 2 with all corners rounded as illustrated by the number 42. The cut off corners 44 can be discarded or recycled.

Figure 2A:
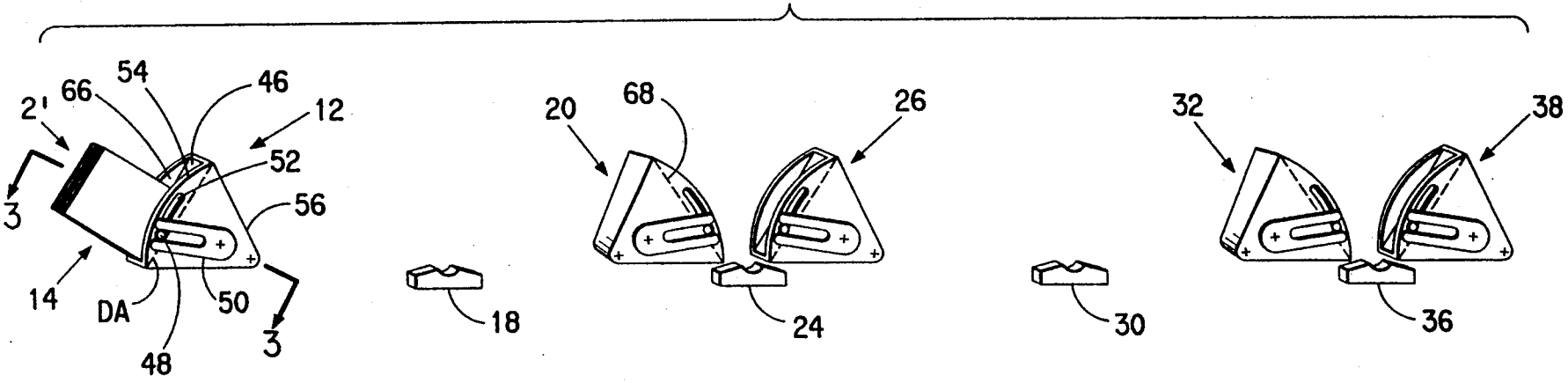
FIGS. 2A illustrates the step of loading a first stack of sheets in a first rotatable assembly in accordance with the present invention.
Figure 3:
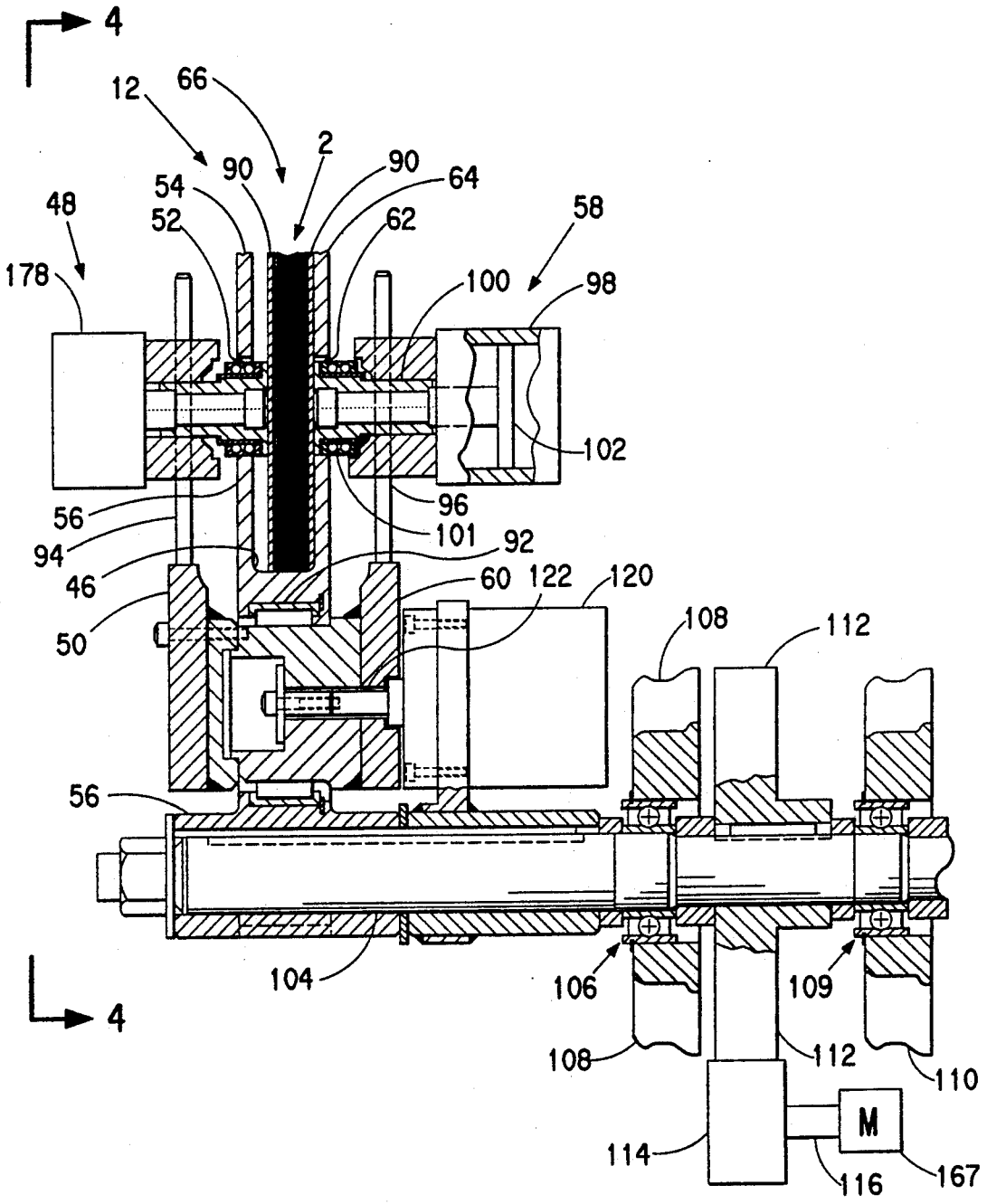
FIG. 3 is a detailed sectional view of the first rotatable assembly taken generally on the line 3—3 of FIG. 2A in the direction of the arrows.

FIG. 2A illustrates the step of loading a first stack 2' of sheets 4 in or on the first rotatable assembly 12 in accordance with the present invention. First, a first edge DA of the first stack 2' of one or more substantially square or substantially rectangular sheets 4 is placed or located in the loading position 14 in contact with a first surface 46 of the first rotatable assembly 12. Referring also to FIG. 3, a front clamp 48 extends from a rotatable front arm 50 through a slot 52 in a front wall 54 of a rotatable device 56 to hold the first stack 2' in contact with and in position with respect to the first surface 46. A back clamp 58 may also extend from a rotatable back arm 60 through a slot 62 in a back wall 64 of the rotatable device 56 to hold the stack 2' near the middle of a groove 66 defined by the front wall 54, the back wall 64 and the first surface 46. In the loading position 14, the clamps 48 and 58 are positioned substantially in first ends of the slots 52 and 62, respectively, and the first ends of the slots 52 and 62 are lower than second ends of the slots 52 and 62.

Figure 2B:
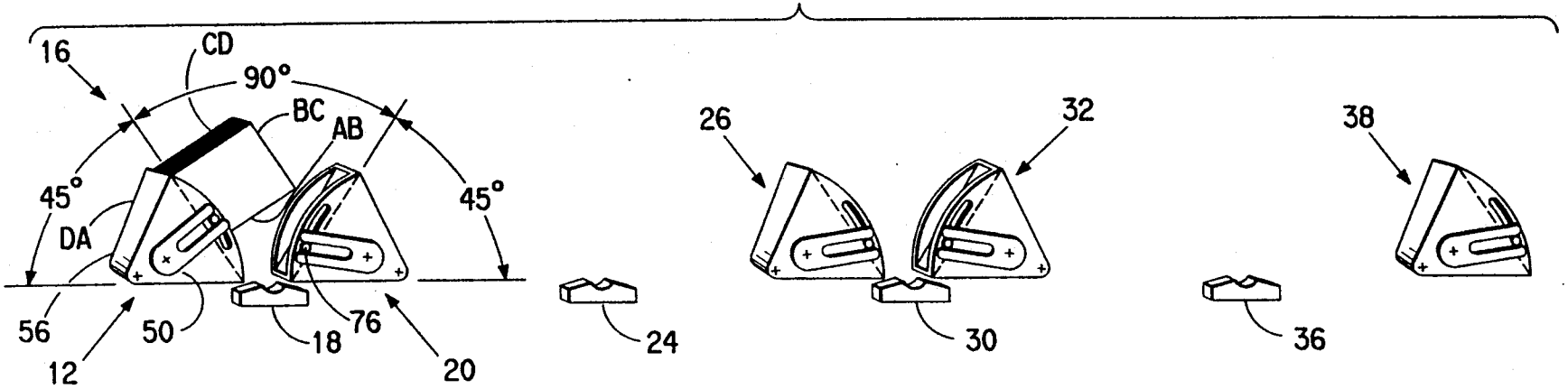
FIGS. 2B illustrates the step of pivoting and sliding the stack generally into position above a first cutting station in accordance with the present invention.

FIG. 2B illustrates the step of rotating or pivoting the first stack 2' generally into position above the first preparing or cutting station 18 in accordance with the present invention. In FIG. 2B, it can be seen that the first rotatable assembly 12 has rotated causing the first stack 2' to rotate such that the first corner A is directed substantially downward. The first stack 2' then slides down along the first surface 46 to or substantially to the first preparing position 16. This can be accomplished by releasing the hold on the first stack 2' by the clamps 48 and 58 allowing the first stack 2' to slide down the first surface 46 by gravity aligning each sheet 4 in the stack 2' with each other in the corner A. Alternatively, the arms 50 and 60 can be allowed (due to gravity) or driven to rotate with respect to the first rotatable device 56 causing the first stack 2' to slide down the first surface 46 aligning the sheets 4 in the stacks 2' with each other in the corner A and guiding it along the way as illustrated in FIGS. 2B and 2C.

At this point, a second edge AB of the first stack 2' is in contact with a second surface 68 of the second rotatable assembly 20, made like the first rotatable assembly 12. Each one of rotatable assemblies 12, 20, 26, 32 and 38 can be made configured like the aforedescribed first rotatable assembly 12. The first stack 2' is now substantially in the first preparing position 16. However, all of the sheets 4 in the first stack 2' may not be properly aligned with their lower corners A at the same height. As such, the sheets 4 of the first stack 2' are further moved or adjusted to facilitate or ensure alignment of the sheets 4 in the first stack 2' into the first preparing position 16.

Figure 2C:
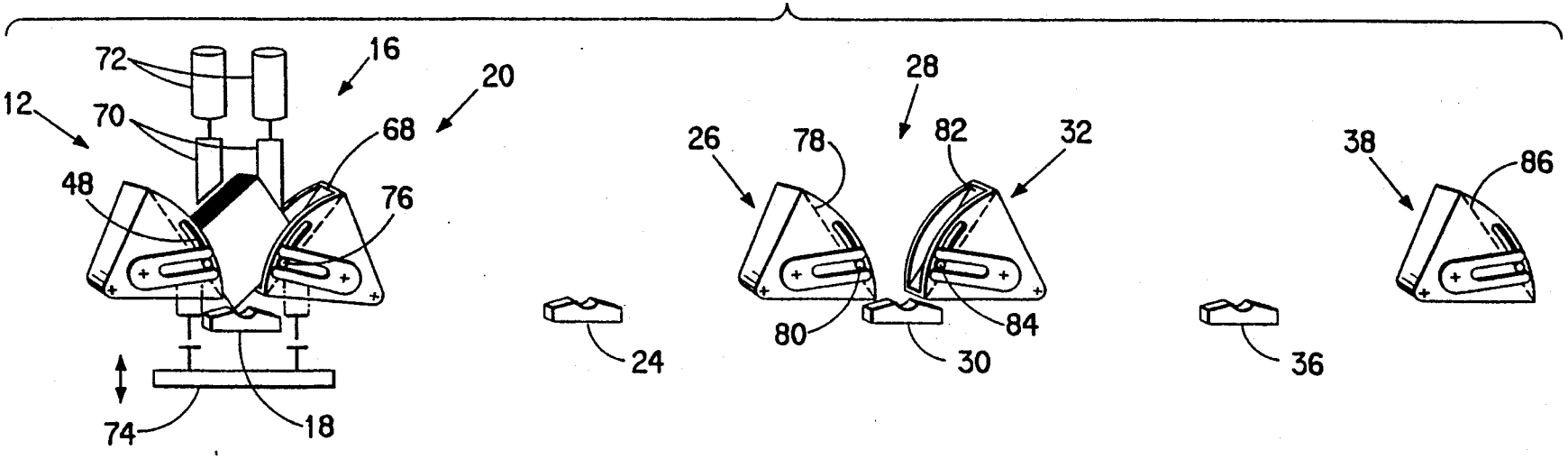
FIGS. 2C illustrates the step of aligning the stack and cutting a first stack corner in accordance with the present invention.

Referring to FIG. 2C, once the first stack 2' slides down the first surface 46, then the first clamps 48 and 58 release their hold on the first stack 2' (if they didn't already release their hold prior to the first stack 2' sliding down the first surface 46). Then a tamping force can be applied to upper edges BC and CD of the first stack 2' to facilitate alignment of the first stack 2' into the first preparing position 16. The tamping force can be applied by weights 70 connected to pneumatic cylinder and rod assemblies 72. Alternatively, or in addition to the tamping force applied to the upper edges BC and CD, the lower edges AB and DA of the first stack 2' can be jogged, such as by a jogging assembly 74, to facilitate alignment of the first stack 2' into the first preparing position 16. After the sheets 4 have been aligned, either the front clamp 48 of the first rotatable assembly 12 or the front clamp 76 of the second rotatable assembly 20, or both, extends to hold the first stack 2' in the first preparing (e.g., cutting) position 16. Then the first cutter 18 rounds the first corner A, defined by the intersection of the first edge DA and the second edge AB, in accordance with the present invention.

After the first preparing station 18 performs its operation on the first stack 2', the first front clamp 48 releases its hold on the stack 2', if it was holding the stack 2'. The second front clamp 76 extends (if not already extended) and the second back clamp (not depicted) extends to hold the first stack 2'. Then the second rotatable assembly 20 rotates or pivots the first stack 2' generally into position above the second cutting station 24. See FIG. 2D.

At the same time, the first rotatable assembly 12 can be rotated or pivoted back to its original or loading position 14. Then a second stack 2'' of sheets 4 is placed in the first rotatable assembly 12. Further, the first stack 2' is now positioned to slide down the second surface 68 of the second rotatable assembly 20.

Specifically, after the second edge AB of the first stack 2' slides down the second surface 68 of the second rotatable assembly 20, the second front clamp 76 and the second back clamp (not depicted) release the first stack 2' (if they did not already release the first stack 2' prior to it sliding down the second surface 68). The first stack 2' is now substantially in the second preparing position 22 with the third edge BC of the first stack 2' contacting a third surface 78 of the third rotatable assembly 26. Then the upper edges of the first stack 2' can be tamped and/or the lower edges of the first stack 2' can be jogged to align the sheets 4 in the first stack 2' into the second preparing position 22. Then either the front clamp 76 of the second rotatable assembly 20 or the front clamp 80 of the third rotatable assembly 26, or both, extend(s) to hold the first stack 2' in the second preparing (e.g., cutting) position 22. Then the second cutter 24 rounds the second corner B defined as or by the intersection of the second edge AB and the third edge BC.

After the second preparing station 24 performs its operation on the first stack 2', the second front clamp 76 releases its hold on the first stack, if it was holding the first stack 2'. The third front clamp 80 extends (if not already extended) and the third back clamp (not depicted) optionally extends to hold the first stack 2'. Then the third rotatable assembly 26 rotates or pivots the first stack 2' generally into position above the third cutting station 30.

At the same time, the second rotatable assembly 20 can be rotated or pivoted back to its position illustrated in FIG. 2B. Then the second stack 2'' of sheets 4 is placed in contact with the second surface 68 of the second rotatable assembly 20 in the position that the first stack 2' is illustrated in FIG. 2C. Further, the first stack 2' is now positioned to slide down the third surface 78 of the third rotatable assembly 26 in the position illustrated in FIG. 2C.

Then the third edge BC of the first stack 2' slides down the third surface 78 of the third rotatable assembly 26. The third front clamp 80 and the third back clamp (not depicted) release the first stack 2' (if they did not already release the first stack 2' prior to it sliding down the third surface 78). The first stack 2' is now substantially in the third preparing position 28 with the fourth edge CD of the first stack 2' contacting a fourth surface 82 of the fourth rotatable assembly 32 in the position illustrated in FIG. 2C. Then the upper edges of the first stack 2' can be tamped and/or the lower edges of the first stack 2' can be jogged to align the sheets 4 in the first stack 2' into the third preparing position 28. Then either the front clamp 80 of the third rotatable assembly 26 or a front clamp 84 of the fourth rotatable assembly 32, or both, extend(s) to hold the first stack 2' in the third preparing (e.g., cutting) position 28. Then the third cutter 30 rounds the third corner C defined as or by the intersection of the third edge BC and the fourth edge CD.

After the third preparing station 30 performs its operation on the first stack 2', the third front clamp 80 releases its hold on the first stack 2', if it was holding the first stack 2'. The fourth front clamp 84 extends (if not already extended) and the fourth back clamp (not depicted) optionally extends to hold the first stack 2'. Then the fourth rotatable assembly 32 rotates or pivots the first stack 2' generally into position above the fourth cutting station 36.

Figure 2D:
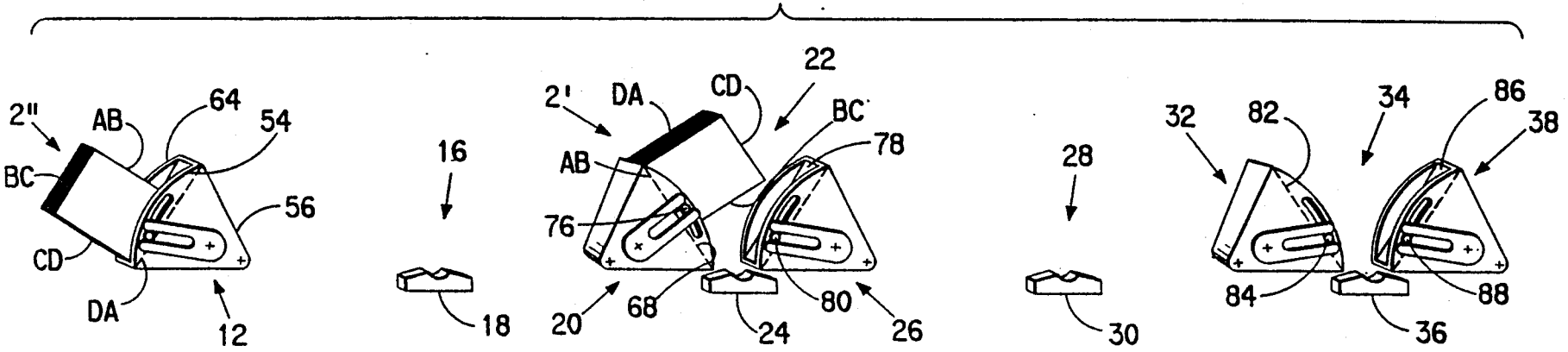
FIGS. 2D illustrates the step of loading a second stack of sheets in the first rotatable assembly and the step of pivoting and sliding the first stack generally into position above a second cutting station in accordance with the present invention.

At the same time, the third rotatable assembly 26 can be rotated or pivoted back to its position illustrated in FIG. 2D. Then the second stack 2'' of sheets 4 is placed in contact with the third surface 78 of the third rotatable assembly 26. Further, the first stack 2' is now positioned to slide down the fourth surface 82 of the fourth rotatable assembly 32.

Then the fourth edge CD of the first stack 2' slides down the fourth surface 82 of the fourth rotatable assembly 32. The fourth front clamp 84 and the fourth back clamp (not depicted) release the first stack 2' (if they did not already release the first stack 2' prior to it sliding down the fourth surface 82). The first stack 2' is now substantially in the fourth preparing position 34 with the first edge DA of the first stack 2' contacting a fifth surface 86 of the fifth rotatable assembly 38. Then the upper edges of the first stack 2' can be tamped and/or the lower edges of the first stack 2' can be jogged to align the sheets 4 in the first stack 2' into the fourth preparing position 34. Then either the front clamp 84 of the fourth rotatable assembly 32 or the front clamp 88 of the fifth rotatable assembly 38, or both, extend(s) to hold the first stack 2' in the fourth preparing (e.g., cutting) position 34. Then the fourth cutter 36 rounds the fourth corner D defined as or by the intersection of the fourth edge CD and the first edge DA.

After the fourth preparing station 36 performs its operation on the first stack 2', the fourth front clamp 84 releases its hold on the first stack 2', if it was holding the first stack 2'. The fifth front clamp 88 extends (if not already extended) and the fifth back clamp (not depicted) optionally extends to hold the first stack 2'. Then the fifth rotatable assembly 38 rotates or pivots the first stack 2' to the unloading position 40.

At the same time, the fourth rotatable assembly 32 can be rotated or pivoted back to its position illustrated in FIG. 2B and 2C. Then the second stack 2" of sheets 4 is placed in contact with the fourth surface 82 of the fourth rotatable assembly 32.

The above described process can be repeated with other or subsequent stacks 2 of sheets 4 as partially described with respect to the second stack 2".

Preferably, the sheets 4 in a stack 2 are substantially the same size. Further, if the sheets 4 are relatively flexible, then firmer end sheets 90, such as made of cardboard, can be placed on the front end and the back end of the stack 2. See FIG. 3. The above described process works well for sheets 4 of X-ray film. Different stacks 2', 2", etc., can have different shapes or different size sheets 4 without changing or adjusting the apparatus. For instance, the sheets 4 in the first stack 2' can be substantially 8 inches by 11 inches. The next or second stack 2" can be 5 inches by 7 inches or 7 inches by 7 inches.

FIG. 3 is a detailed sectional view of one embodiment of the first rotatable assembly 12 taken generally on the line 3—3 of FIG. 2A in the direction of the arrows. The first rotatable assembly 12 comprises the first rotatable device 56 having the first surface 46, the front wall 54 and the back wall 64. The first surface 46, the front wall 54 and the back wall 64 define the space or groove 66 for receiving the stack 2 of sheets 4. Slots 52 and 62 are formed in both the front and back walls 54 and 64, respectively. The first rotatable assembly 12 further comprises the front arm 50 and the back arm 60 connected to the front arm 50 through a bearing assembly 92 in the first device 56. The first front clamp 48 is slideably mounted on fingers 94 of the first front arm 50. The back clamp 58 is slideably mounted on fingers 96 of the back arm 60. Each of the clamps 48 and 58 comprise a pneumatic cylinder 98, a rod assembly 100 having a first end and a second end, the first end connected to a piston 102 within the cylinder 98, the second end extending through a bearing assembly 101 in one of the slots 62 and positioned to grasp or hold the stack 2 within the groove 66 when the rod assembly 100 is extended and the second end is positioned to release the stack 2 when the the rod assembly 100 is retracted towards its cylinder 98.

The first device 56 is connected to a rotatable drive shaft 104 which is supported by a first bearing assembly 106 in a first frame or support portion 108 and a second bearing assembly 109 in a second frame or support portion 110. The drive shaft 104 is connected to a gear 112 which can be connected to other gears, or a drive train, ultimately connected to and driven by a gear 114 on a shaft 116 of a motor 167.

The first device 56 or the drive shaft 104 is connected to a rotator 120 having a rotatable shaft 122 connected to the front arm 50 and the back arm 60. The rotator 120 permits and causes the arms 50 and 60 to rotate with respect to the first device 56.

Figure 4:
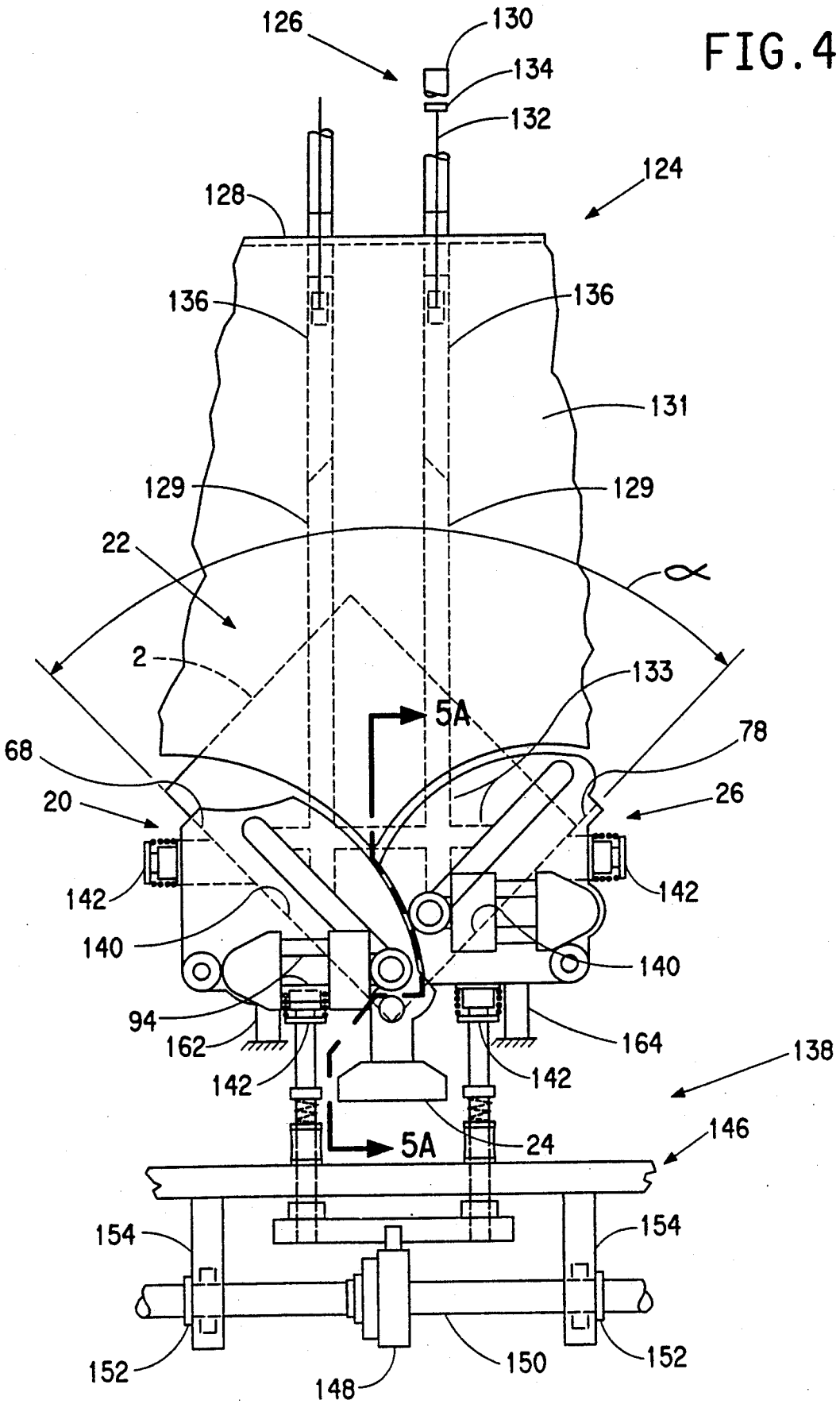
FIG. 4 is a front elevation view of the second rotatable assembly and the third rotatable assembly taken in the direction of the arrows on line 4—4 of FIG. 3 where the assemblies are oriented as illustrated in FIG. 2A.

FIG. 4 is an front elevation view of the second rotatable assembly 20 and the third rotatable assembly 26 taken in the direction of the arrows on line 4—4 of FIG. 3 where the assemblies 20 and 26 are oriented essentially as illustrated in FIG. 2A. FIG. 4 shows means 124 for applying a tamping force to upper edges of the stack 2 when the stack 2 is positioned substantially in the second cutting position 22 to facilitate alignment of the stack 2 into the first cutting position 16. Specifically, the applying means 124 comprises a pair of pneumatic cylinder and rod assemblies 126 connected to a support 128 above the second preparing position 22. Each of the pneumatic cylinder and rod assemblies 126 comprises a pneumatic cylinder 130 connected to the support 128 and a rod 132 having a first end and a second end. The first rod end is connected to a piston 134 within the cylinder 130. The second rod end is connected to a tamping weight 136 positioned below the cylinder 130 and above one of the upper edges of the stack 2. When air pressure is exerted on one side of the pistons 134 within the cylinders 130, the rods 132 are extended and the tamping weights 136 are tamped down onto the upper edges of the stack 2 and when air pressure is exerted on the other side of the pistons 134 within the cylinders 130, the rods 132 are retracted from the stack 2. The tamping weights 136 are guided to the stack 2 by slots 129 in side plates 131. The side plates 131 further guide the stacks 2 as they are transported from one preparing position to the next. Extensions 133 of the slots are in the inside surfaces of the front and back walls of the assemblies 20 and 26. The extensions 133 guide the tamping weights 136 through the groove of the assembly to the upper edges of the stack 2 when the upper edges of the stack 2 do not extend above the front and back walls.

FIG. 4 further shows means 138 for jogging lower edges of the stack 2 when the stack 2 is positioned substantially in the second cutting position 22 to facilitate alignment of the stack 2 into the second cutting position 22. Specifically, the jogging means 138 comprises a displaceable surface portion 140 which is connected to a jogging shaft 142. The displaceable surface portion 140 is biased by a compression spring 144 to position the displaceable surface portion 140 into the same plane as the surface 46, 68, 78, 82 or 86 in the corresponding rotatable assembly 12, 20, 26, 32 or 38. Each of the assemblies 20, 26 and 32 includes two of the displaceable surface portions 140; assemblies 12 and 38 require only one of the displaceable portion 140. This enables the stack 2 to be jogged, for instance, through the second rotatable assembly 20 when the second rotatable assembly 20 is oriented as illustrated in FIG. 2A or 2D after the stack 2 has slid down the second surface 68.

When a lower end of each of the jogging shafts 142 is substantially vertical, the shaft 142 is positioned adjacent a jogging assembly 146 positioned above a cam 148 on a rotatable shaft 150. The rotatable shaft 150 can be supported in bearing assemblies 152 to supports 154 and connected to adjacent cams and a drive train connected to a shaft of a motor. When the motor turns, it rotates the cam 148 which bumps the jogging assembly 146 which bumps the lower end of the substantially vertical jogging shafts 142 which displaces the displaceable surface portions 140 in the rotatable assemblies 12, 20, 26, 32 and 38 which jogs the sheets 4 in the stacks 2 into alignment.

Where the end cardboard sheets 90 or the other sheets 4 have a corner angle greater than 90 degrees, the angle $\alpha$ between the second surface 68 and the third surface 78 when they are in the second cutting position 20 can be set at about 92 degrees to 94 degrees so the cardboard corners and other interior sheet corners will always fall low enough to come between cutting elements of the cutter 24.

Figure 5A:
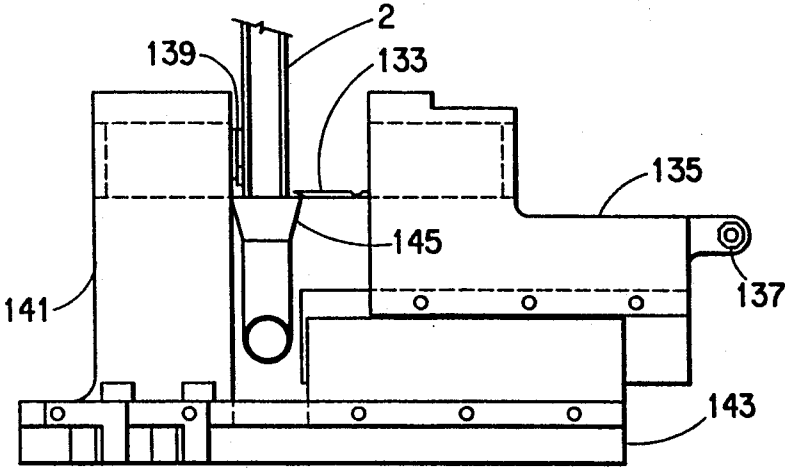
FIG. 5A is a left side elevation view of the second cutting station taken generally on the line 5A—5A of FIG. 4 taken in the direction of the arrows with certain parts removed for clarity.
Figure 5B:
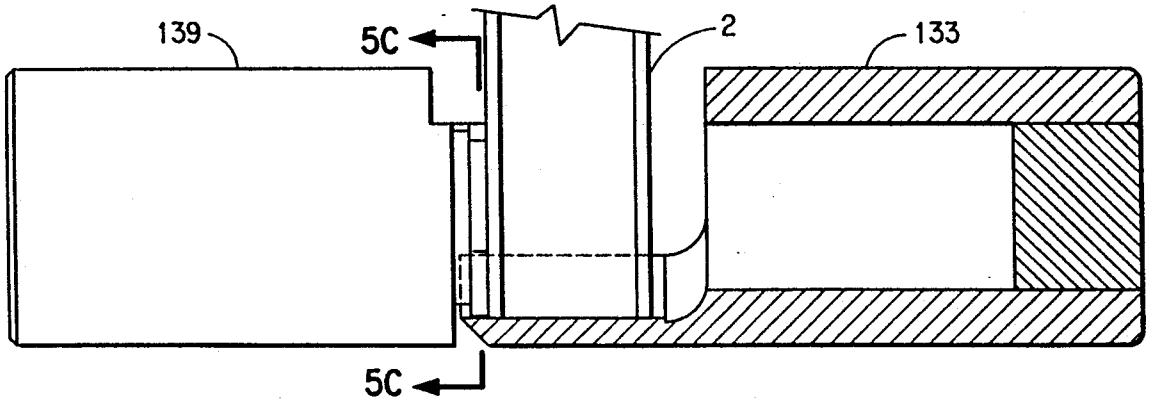
FIG. 5B is an enlarged view with certain parts in section of a portion of the second cutting station illustrated in FIG. 5A.
Figure 5C:
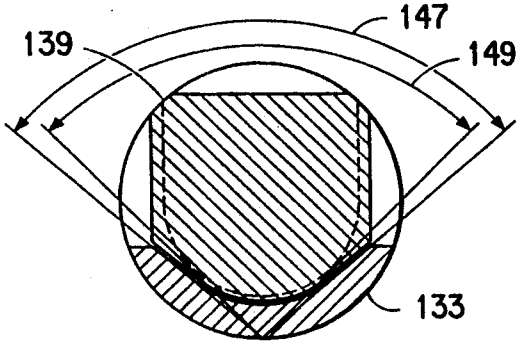
FIG. 5C is a front side sectional view of part of the cutting station taken generally on the line 5C—5C of FIG. 5B in the direction of the arrows.

FIG. 5A shows a side elevation of a cutting station 18 which can also be illustrative of each of one of the stations 24, 30 and 32. The cutting station 18 consists of a moveable cutter blade 133 in a moveable guided housing 135 that engages a driving mechanism 137; and a stationary cutter blade 139 in a stationary housing 141, with both housings 135 and 141 aligned with each other on a common base 143. The stack 2 is placed between the moveable cutter blade 133 and the stationary cutter blade 139. The stack 2 can be positioned against the stationary cutter blade 139 by the front clamps of the rotatable assemblies holding the stack 2. The moveable cutter blade 133 is forced through the stack 2 and past the leading edge of the stationary cutter blade 139 as shown in an enlarged view in FIG. 5B thereby cutting off the bottom corner of the stack 2. The cut off corner can be carried away from the cutter 18 by suction through a chute 145. Preferably, the cutter blade angle 147 shown in FIG. 5C is slightly greater than the stack angle 149 of the corner so the cut corner blends without notching into the edge of the sheets 4. For instance, for a stack angle of 90 degrees, a suitable cutter blade angle 147 may be about 100 degrees. Such cutters are known to be commercially available from cutting equipment vendors, such as the W. 0. Hickok Mfg. Co. of Harrisburg, Pa.

Figure 6:
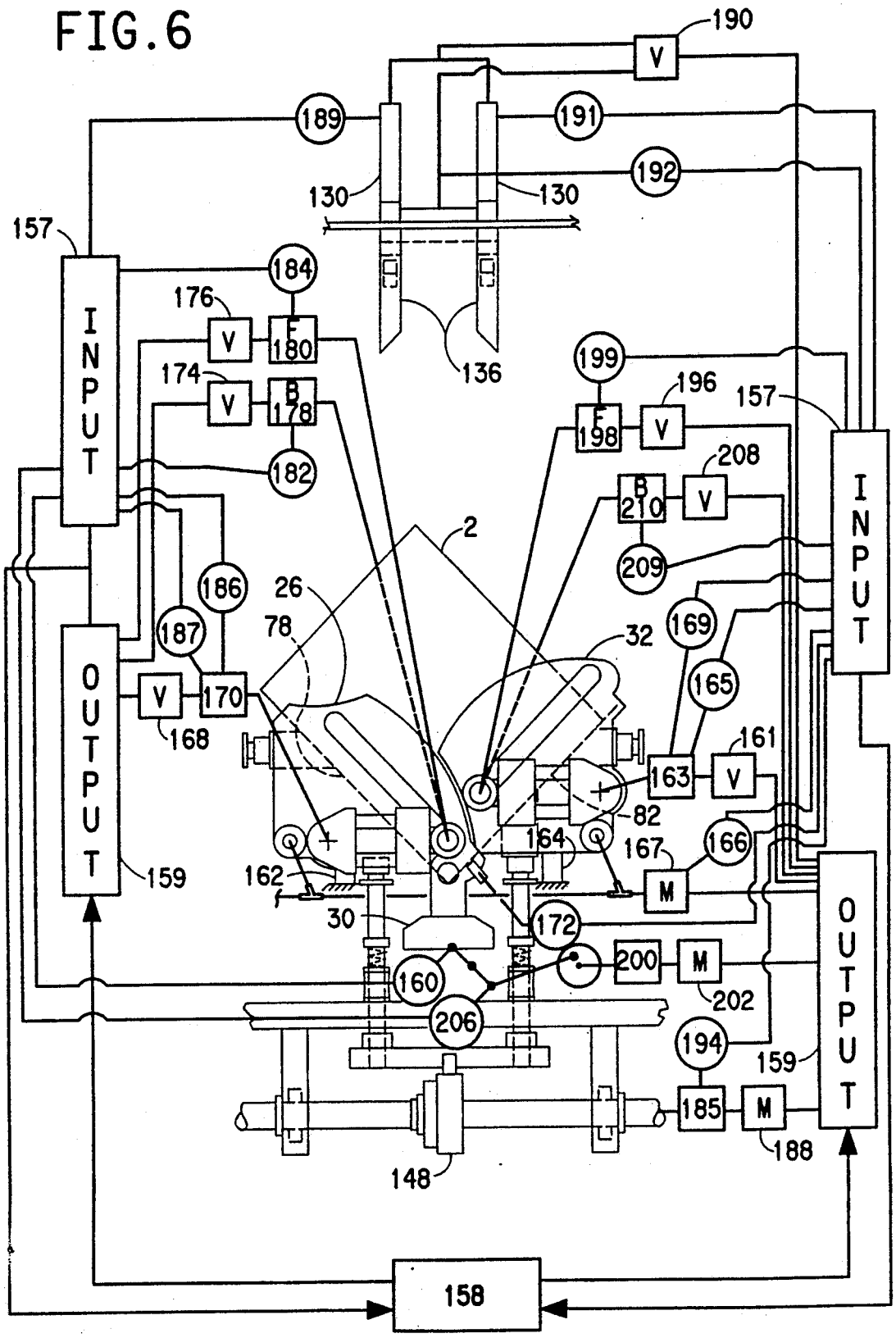
FIG. 6 is a schematic illustration of the apparatus for automatically preparing one or more stacks of sheets, each of the stacks having at least first and second substantially straight edges that meet to define a first corner in accordance with the present invention.

FIG. 6 is a schematic illustration of the apparatus for automatically preparing one or more stacks 2 of sheets 4 in accordance with the present invention. FIG. 6 shows means for automatically controlling the apparatus for preparing one or more stacks of sheets in accordance with the present invention. Located throughout the apparatus where appropriate to ensure safe and non-destructive operation of the apparatus, there are appropriate sensors to confirm that particular events have taken place. The output of these sensors is communicated to a controller 158 which determines the next step and outputs the appropriate command to the actuators on the apparatus or notifies an operator that corrective action is required. To simplify FIG. 6, the inputs and outputs are shown going to input terminals 157 and output terminals 159 that represent pathways to the controller 158. This system of sensors and actuators is best understood by stepping through a typical cycle of operation of the apparatus referring to a single cutting station, such as cutter 30, as depicted in FIGS. 1 and 6. The cycle starts with a stack 2 of sheets 4 clamped in the rotatable assembly 26 in the preceding cutting station, i.e, cutter 24. A sensor 160 in FIG. 6 detects that the cutter 24 has completed the cut. The controller 158 tells a rotatable assembly servo-motor 167 to rotate a predetermined angle and direction to accomplish about 92 degrees of clockwise rotation for assembly 26. At the same time, the rotatable assembly 32, which does not contain a stack, rotates counterclockwise about 92 degrees. As a result, assembly 26 is down against a stop 162 and the assembly 32 is down against a stop 164.

When the controller 158 receives a signal from a servo sensor 166 that the assembly rotation is complete, the controller 158 tells a valve 168 to shift to cause the rotator 170 to rotate the front and back arms 50 and 60 (FIG. 3) of the assembly 26 clockwise to the position shown in FIG. 6. This causes the stack 2 to slide down the surface 78 of the assembly 26 so the corner C is adjacent the cutter 30. At the same time, the controller 158 tells a valve 161 to shift to cause rotator 163 to rotate the front and back arms 50 and 60 on the assembly 32 counterclockwise to the position shown in FIG. 6. Counter-clockwise sensor 165 detects that a fixed stop in the rotator 163 has been reached and the rotation of the front and back arms 50 and 60 on the assembly 32 is complete. Clockwise sensor 169 is used in the clockwise position of the assembly 32 to detect completion of clockwise rotation of the front and back arms 50 and 60 on the assembly 32.

Sensor 172 detects the stack 2 is against the surface 82 of the assembly 32, and based on this input, the controller 158 tells clamp valves 174 and 176 to shift to cause the rod assemblies 100 to retract thereby releasing the stack 2. The arms 50 and 60 may now continue rotating clockwise until clockwise sensor 186 detects that a fixed stop in the rotator 170 is reached. Counter-clockwise sensor 187 is used in the counter-clockwise position of assembly 26 to detect completion of counter-clockwise rotation of the arms.

At the same time as the clamp valves 174 and 176 are told to shift, the controller 158 tells the jogger single-revolution clutch 185 to engage thereby permitting a continuously running motor 188 to begin driving the jogging cam 148 through one revolution. Simultaneously, the controller 158 tells tamping valve 190 to shift to cause the two cylinders 130 to lower the tamping weights 136 down against the upper edges of the stack 2. Flow sensor 192 detects cylinder exhaust gas flow which will drop to zero when the cylinder stops moving down due to the weights 136 resting against the upper edges of the stack 2. When the sensor 192 detects zero flow, the controller 158 tells the valve 190 to shift to cause the cylinders 130 to raise the tamping weights 136 up. Sensors 189 and 191 indicate to the controller 158 that the tamping weights 136 are up.

When the single-revolution clutch 185 has completed a single revolution, a sensor 194 sends a signal to the controller 158 which tells valves 176 and 196 for the cylinders 98 to shift to cause the front clamps 180 and 198 respectively to clamp the stack 2. After pressure sensors 184 and 199 sense there is clamp pressure to clamp the stack 2, the controller 158 tells a cutter clutch/brake 200 to engage to permit the cutter motor 202 to drive the cutter 30 to cause it to cut and retract. The sensor 160 signals the controller 158 that the cutter 30 has completed a cut so the rest of the cycle can proceed. Sensor 206 tells the controller 158 that the cutter 30 has retracted so the controller 158 can cause the clutch/brake 200 to brake the cutter motion to stop.

Based on the sensor 160 signalling the controller 158 the cut is complete, the controller 158 tells the valve 176 to shift to retract the piston assembly 100 in the front clamp cylinder 180 of the assembly 26 and tells valve 208 to shift to extend the piston assembly 100 associated with the back clamp cylinder 210 of the assembly 32. When sensor 209 confirms that the piston assembly 100 associated with the clamp cylinder 210 is extended, the controller 158 tells the servo-motor 167 to rotate the assembly 32 clockwise about 92 degrees to thereby deliver the stack 2 to the next cutting station or cutter 36. Simultaneously, the assembly 26 rotates counter-clockwise about 92 degrees to accept the next stack at cutter 24. The sensors and actuators just described are typical for the various rotatable assembly and cutting stations.

When the stack preparation apparatus is fully automated to include automatic loading and unloading of the stack 2, rotatable assemblies 12 and 38 may perform another rotation orthogonal to those previously discussed to lay the stack 2 in a plane perpendicular to that required for cutting. Means to load and remove the stack 2 from the assemblies 12 and 38 are also provided. Control of suitable valves and cylinder actuators and use of pressure and position sensors as described above will enable one skilled in the art to provide coordinated automatic control of the means to load and remove the stack 2 as well.

Figure 7:
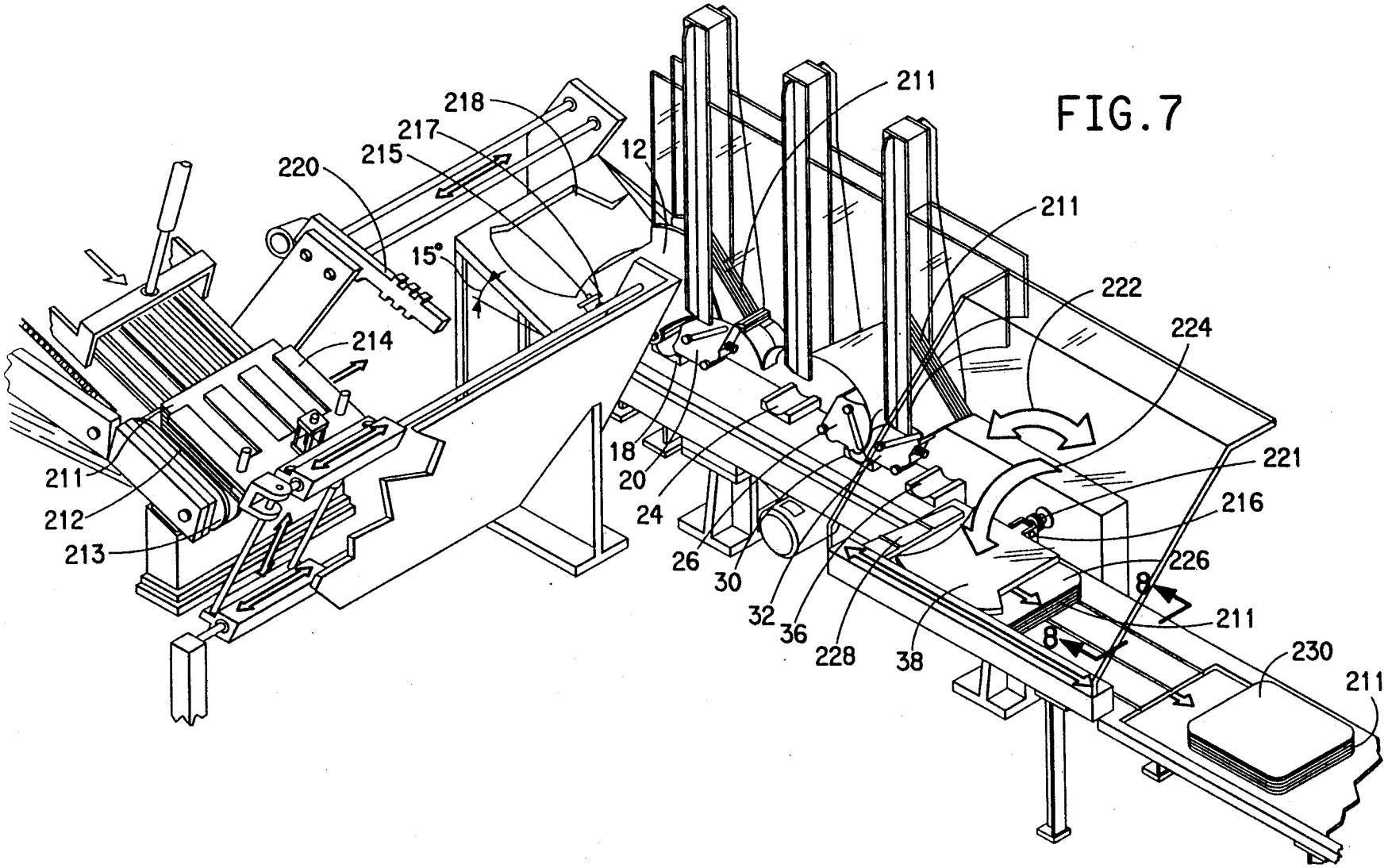
FIG. 7 is a conceptual isometric sketch of a fully automated version of the apparatus of the present invention where stacks 211 are automatically loaded and unloaded in the apparatus.
Figure 8:
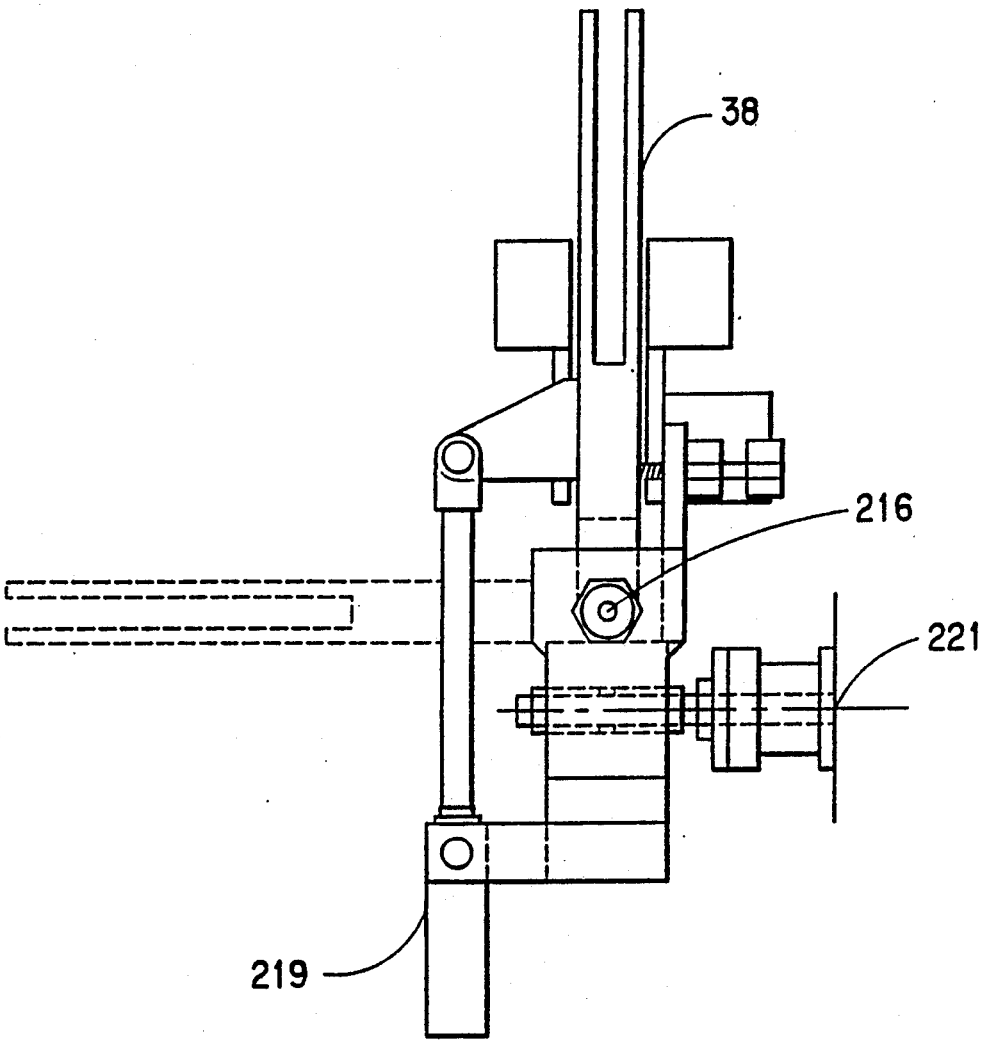
FIG. 8 is an enlarged view taken in the direction of the arrows on line 8—8 in FIG. 7 showing a pivot for the fifth assembly 38 and a cylinder assembly which enables the fifth assembly to rotate about the pivot.

FIG. 7 is a conceptual isometric sketch of a fully automated version of the apparatus of the present invention where stacks 211 are automatically loaded and unloaded in the apparatus previously described. For clarity in FIG. 7, the tamping devices and other details are not shown. The film which has been slit and chopped into sheets 4 is delivered as a stack at 212 to a transport 214 which takes the stack 211 from a multiple belt conveyor 213 and moves the stack 211 laterally toward the stack preparation apparatus. The rotatable assemblies 12 and 38 have a rotatable pivot, such as at 215 and 216, respectively, and means to rotate the assemblies (such as cylinder assembly 219 in FIG. 8) into a plane perpendicular to the plane of the stack 211 for cutting. For automatic loading, the assembly 12 is rotated counterclockwise, from the position shown, about 31 degrees around an axis 217. The assembly 12 is then rotated down around pivot 215, in a rotational plane orthogonal to the first plane of rotation, for about 90 degrees. This places the assembly 12 in the position shown at 218 where it is ready to accept a stack 211 of film from the transporter 214. A pusher, such as 220, pushes the stack 211 from the transporter 214 into the rotatable assembly 12 between the front and back walls, such as 54 and 64 seen in FIG. 3. The front and back clamps 48 and 58 for assembly 12 are extended to clamp the stack 211 and the assembly 12 is rotated 90 degrees up about axis 215 to place the stack 211 in the plane for cutting.

The stacks 211 are processed successively at cutters 18, 24, 30 and 36 by pivoting and passing the stacks 211 with rotatable assemblies 12, 20, 26, 32 and 38 as previously described. The rotatable assembly 38 clamps the stack 211 at cutter 36 and then rotates about an axis 221 for about 46 degrees clockwise, shown by arrow 222, to bring the edges of the stack 211 into vertical and horizontal orientations. The assembly 38 then rotates down around pivot 216 for about 90 degrees as shown by arrow 224 to place the stack 211 in a horizontal orientation as shown at 226. The front and back clamps on the assembly 38 are then released. A pusher 228 can then push the stack 211 out from between the front and back walls or plates of the assembly 38 and into an unloading position 230 where the stack 211 can be carried off for further processing. The assembly 38 is then rotated up about pivot 216 where it can return to a position to accept the next stack.

The assemblies 12 and 38 are rotated around axes 215 and 216, respectively, by the same servo motor 167 as the other assemblies 20, 26 and 32. To achieve the reduced degrees of rotation different from the other assemblies 20, 26 and 32, the assembly 12 is rotationally driven through a 3 to 1 reduction gearing and the assembly 38 is rotationally driven through a 2 to 1 reduction gearing.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. An apparatus for automatically preparing one or more stacks of sheets, each of the stacks having at least a first and a second substantially straight edge that meet to define a first corner comprising:

a first rotatable assembly including:

a first device rotatable about an axis, the first device having a first surface for contacting the first edge of a first one of the stacks;

first means for holding the first edge of the first stack in contact with the first surface;

first means for moving the first device from a stack loading position to a first preparing position;

a second surface for contacting the second edge of the first stack; and means for preparing the first stack at or a predetermined distance from the first corner of the first stack when the first edge is on the first surface and the second edge is on the second surface and the first corner is directed substantially downward.

2. The apparatus of claim 1, wherein the preparing means is capable of corner rounding, notching, hole punching or edge marking the first stack.

3. An apparatus for automatically rounding corners of one or more stacks of sheets, each of the stacks having at least a first and a second substantially straight edge that meet to define a first corner comprising:

a first rotatable assembly including:

a first device rotatable about an axis, the first device having a first surface for contacting the first edge of a first one of the stacks;

first means for holding the first edge of the first stack in contact with the first surface;

first means for moving the first device from a stack loading position to a first cutting position;

a second rotatable assembly including:

a second device rotatable about an axis, the second device having a second surface for contacting the second edge of the first stack;

second means for holding the second edge of the first stack in contact with the second surface;

second means for rotating the second device from the first cutting position to a second position; and a first cutter positioned to cut off the first corner of the first stack in a rounded fashion when the first edge is on the first surface and the second edge is on the second surface and the first corner is directed substantially downward.

4. The apparatus of claim 3, further comprising:

means for applying a tamping force to upper edges of the stack when the stack is positioned substantially in the first cutting position to facilitate alignment of the stack into the first cutting position.

5. The apparatus of claim 4, wherein the applying means comprises a pair of pneumatic cylinder and rod assemblies, each of the pneumatic cylinder and rod assemblies comprising:

a pneumatic cylinder; and a rod having a first end and a second end, the first end connected to a piston within the cylinder, the second end connected to a tamping weight positioned out of the cylinder and above one of the upper edges of the stack, such that when air pressure is exerted on one side of the piston within the cylinder the rod is extended and the tamping weight is tamped down onto the upper edge of the stack and when air pressure is exerted on the other side of the piston within the cylinder the rod is retracted from the stack.

6. The apparatus of claim 3, further comprising:

means for jogging lower edges of the first stack when the stack is positioned substantially in the first cutting position to facilitate alignment of the stack into the first cutting position.

7. The apparatus of claim 3, wherein;

the first holding means is also for sliding the first edge of the first stack along the first surface; and the second holding means is also for sliding the second edge of the first stack along the second surface.

8. The apparatus of claim 7, wherein:

the first rotatable device further comprises a front wall and a back wall which together with the first surface define a groove for receiving the first edge of the stack, both the front wall and the back wall have a slot extending into the groove, each of the slots having a first end and a second end; and the first holding and sliding means comprises a rotatable front arm, a rotatable back arm, a front extendable clamp connected to the front arm and extending from the front arm through the front wall slot into the groove, a back extendable clamp connected to the back arm and extending from the back arm through the back wall slot into the groove, and means for extending and retracting the front and back clamps to hold and release the stack when the stack is in the groove, such that when the first device is in its stack loading position the clamps are positioned substantially in the first slot ends and when the first device is in its first cutting position the clamps are positioned substantially in the second slot ends and the second slot ends are lower than the first slot ends.

9. The apparatus of claim 3, further comprising:

a third rotatable assembly including:

a third device rotatable about an axis, the third device having a third surface for contacting a third edge of the first stack;

third means for holding the third edge of the first stack in contact with the third surface;

third means for rotating the third device from the second position which is a second cutting position to a third position; and a second cutter positioned to cut off a second corner of the first stack in a rounded fashion, the second corner defined by the intersection of the second edge and the third edge, when the second edge is on the second surface and the third edge is on the third surface and the second corner is directed substantially downward.

10. The apparatus of claim 9, further comprising:

a fourth rotatable assembly including:

a fourth device rotatable about an axis, the fourth device having a fourth surface for contacting a fourth edge of the first stack;

fourth means for holding the fourth edge of the first stack in contact with the fourth surface;

fourth means for rotating the fourth device from the third position which is a third cutting position to a fourth position; and a third cutter positioned to cut off a third corner of the first stack in a rounded fashion, the third corner defined by the intersection of the third edge and the fourth edge, when the third edge is on the third surface and the fourth edge is on the fourth surface and the third corner is directed substantially downward.

11. The apparatus of claim 10, further comprising:

a fifth rotatable assembly including:

a fifth device rotatable about an axis, the fifth device having a fifth surface for contacting the first edge of the first stack;

fifth means for holding the first edge of the first stack in contact with the fifth surface;

fifth means for moving the fifth device from the fourth position which is a fourth cutting position to a stack unloading position; and a fourth cutter positioned to cut off a fourth corner of the first stack in a rounded fashion, the fourth corner defined by the intersection of the fourth edge and the first edge, when the fourth edge is on the fourth surface and the first edge is on the fifth surface and the fourth corner is directed substantially downward.

12. The apparatus of claim 11, wherein:

the third holding means is also for sliding the third edge of the first stack along the third surface;

the fourth holding means is also for sliding the fourth edge of the first stack along the fourth surface; and the fifth holding means is also for sliding the first edge of the first stack along the fifth surface.

13. The apparatus of claim 12, wherein:

each one of the first, second, third, fourth and fifth rotatable devices further comprise a front wall and a back wall which together with one of the surfaces define a groove for receiving one of the edges of the stack, both the front wall and the back wall have a slot extending into the groove, each of the slots having a first end and a second end; and each one of the first, second, third, fourth and fifth holding and sliding means comprises a rotatable front arm, a rotatable back arm, a front extendable clamp connected to the front arm and extending from the front arm through the front wall slot into the groove, a back extendable clamp connected to the back arm and extending from the back arm through the back wall slot into the groove, and means for extending and retracting the front and back clamps to hold and release the stack when the stack is in the groove, such that in operation the first rotatable assembly grasps the first stack in its stack loading position by extending the clamps of the first rotatable assembly, the first rotatable assembly is rotated to the first cutting position where the second rotatable assembly grasps the first stack by extending the clamps of the second rotatable assembly, the first cutter cuts off the first corner making a first rounded corner on the stack, the first rotatable assembly releases the first stack by retracting the clamps of the first rotatable assembly, the second rotatable assembly is rotated to the second cutting position where the third rotatable assembly grasps the first stack by extending the clamps of the third rotatable assembly, the second cutter cuts off the second corner making a second rounded corner on the stack, the second rotatable assembly releases the first stack by retracting the clamps of the second rotatable assembly, the third rotatable assembly is rotated to the third cutting position where the fourth rotatable assembly grasps the first stack by extending the clamps of the fourth rotatable assembly, the third cutter cuts off the third corner making a third rounded corner on the stack, the third rotatable assembly releases the first stack by retracting the clamps of the third rotatable assembly, the fourth rotatable assembly is rotated to the fourth cutting position where the fifth rotatable assembly grasps the first stack by extending the clamps of the fifth rotatable assembly, the fourth cutter cuts off the fourth corner making a fourth rounded corner on the stack, the fourth rotatable assembly releases the first stack by retracting the clamps of the fourth rotatable assembly, the fifth rotatable assembly is rotated to the stack unloading position where the fifth rotatable assembly releases the first stack by retracting the clamps of the fifth rotatable assembly.

14. The apparatus of claim 3, wherein the first rotatable assembly further comprises:

a rotatable pivot; and means for rotating the first rotatable assembly about the rotatable pivot between a first plane and a second plane, the second plane being substantially perpendicular to the first plane and the first plane being parallel to the sheets in the stack when the stack is in the first cutting position.

15. The apparatus of claim 11, wherein each one of the first rotatable assembly and the fifth rotatable assembly further comprises:

a rotatable pivot; and means for rotating the rotatable assembly about the rotatable pivot between a first plane and a second plane, the second plane being substantially perpendicular to the first plane and the first plane being parallel to the sheets in the stack when the stack is in the first cutting position.

16. A method for automatically preparing one or more stacks of sheets, each of the stacks having at least a first and a second substantially straight edge that meet to define a first corner comprising:

locating the first edge of a first one of the stacks in contact with a first surface;

holding the stack in position with respect to the first surface;

moving the first stack and the first surface to a first preparing position where the second edge of the first stack is in contact with a second surface and the first corner of the first stack is directed substantially downward; and preparing the first stack at or a predetermined distance from the first corner.

17. The method of claim 16, wherein the preparing step comprises corner rounding, notching, hole punching or edge marking the stack.

18. A method for automatically preparing one or more stacks of sheets, each of the stacks having at least a first and a second substantially straight edge that meet to define a first corner comprising:

locating the first edge of a first one of the stacks in contact with a first surface;

holding the stack in position with respect to the first surface;

moving the first stack and the first surface to a first preparing position where the second edge of the first stack is in contact with a second surface and the first corner of the first stack is directed substantially downward, wherein the moving step comprises:

rotating the stack and the first surface such that the first corner is directed substantially downward; and sliding the stack downwards along the first surface to the first preparing position; and preparing the first stack at or a predetermined distance from the first corner.

19. The method of claim 18, wherein the moving step further comprises:

after the rotating step, releasing the hold on the stack allowing the stack to slide down the first surface by gravity; and prior to the preparing step, grasping the stack in the preparing position.

20. The method of claim 18, wherein during the sliding step, the stack is held to guide the stack downward along the first surface.

21. The method of claim 16, wherein the moving step includes:

releasing the hold on the stack when the stack is positioned substantially in the first preparing position;

applying a tamping force to upper edges of the stack to facilitate alignment of the stack into the first preparing position; and prior to the preparing step, grasping the stack in the first preparing position.

22. The method of claim 16, wherein the moving step includes:

releasing the hold on the stack when the stack is positioned substantially in the first preparing position;

jogging lower edges of the stack to facilitate alignment of the stack into the first preparing position; and prior to the preparing step, grasping the stack in the first preparing position.

23. A method for automatically preparing one or more stacks of sheets, each of the stacks having at least a first and a second substantially straight edge that meet to define a first corner comprising:

locating the first edge of a first one of the stacks in contact with a first surface;

holding the stack in position with respect to the first surface;

moving the first stack and the first surface to a first preparing position where the second edge of the first stack is in contact with a second surface and the first corner of the first stack is directed substantially downward;

preparing the first stack at or a predetermined distance from the first corner;

releasing the hold on the stack with respect to the first surface;

holding the stack in position with respect to the second surface;

moving the stack and the second surface to a second preparing position where a third edge of the stack is in contact with a third surface and a second corner of the stack is directed substantially downward, the second corner defined by the intersection of the second edge and the third edge of the stack; and preparing the stack at or a predetermined distance from the second corner of the stack.

24. The method of claim 23, further comprising:

releasing the hold on the stack with respect to the second surface;

holding the stack in position with respect to the third surface;

moving the stack and the third surface to a third preparing position where a fourth edge of the stack is in contact with a fourth surface and a third corner of the stack is directed substantially downward, the third corner defined by the intersection of the third edge and the fourth edge of the stack; and preparing the stack at or a predetermined distance from the third corner of the stack.

25. The method of claim 24, further comprising:

releasing the hold on the stack with respect to the third surface;

holding the stack in position with respect to the fourth surface;

moving the stack and the fourth surface to a fourth preparing position where the first edge of the stack is in contact with a fifth surface and a fourth corner of the stack is directed substantially downward, the fourth corner defined by the intersection of the fourth edge and the first edge of the stack; and preparing the stack at or a predetermined distance from the fourth corner of the stack.

26. The method of claim 25, further comprising:

releasing the hold on the stack with respect to the fourth surface;

holding the stack in position with respect to the fifth surface; and moving the stack and the fifth surface to an unloading position.

27. A method for automatically preparing one or more stacks of sheets, each of the stacks having at least a first and a second substantially straight edge that meet to define a first corner comprising:

locating the first edge of a first one of the stacks in contact with a first surface;

holding the stack in position with respect to the first surface;

moving the first stack and the first surface to a first preparing position where the second edge of the first stack is in contact with a second surface and the first corner of the first stack is directed substantially downward;

preparing the first stack at or a predetermined distance from the first corner; and rotating the first stack about a rotatable pivot between a first plane and a second plane, the second plane being substantially perpendicular to the first plane and the first plane being parallel to the sheets in the stack when the stack is in the first preparing position.

28. The method of claim 26, further comprising:

rotating the first stack about a rotatable pivot from a second plane to a first plane, the second plane being substantially perpendicular to the first plane and the first plane being parallel to the sheets in the stack when the stack is in the first preparing position; and rotating the first stack about a rotatable pivot from the first plane to the second plane.

* * * * *